US006339200B1

(12) United States Patent
Shi et al.

(10) Patent No.: US 6,339,200 B1
(45) Date of Patent: Jan. 15, 2002

(54) ELECTROSTATIC INSULATION FOR AN OPERATING UNIT FOR ELECTRONIC EQUIPMENT

(75) Inventors: Lei Shi; Hideaki Kume, both of Hachioji (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 09/459,659

(22) Filed: Dec. 13, 1999

(30) Foreign Application Priority Data

Dec. 15, 1998 (JP) ..... 10-356380

(51) Int. Cl.[7] ..... W01H 9/00

(52) U.S. Cl. ..... 200/305; 200/292; 200/329; 200/336; 361/799; 361/816; 361/818

(58) Field of Search ..... 200/4, 11 R, 11 D, 200/11 DA, 16 R, 16 A, 17 R, 18, 292, 329, 305, 336, 341; 361/212, 220–223, 799, 800, 816, 818

(56) References Cited

U.S. PATENT DOCUMENTS 4,303,960 A * 12/1981 Sherwood et al. ..... 361/212
5,383,097 A * 1/1995 DeLucia et al. ..... 361/816
6,207,912 B1 * 3/2001 Persson ..... 200/305

FOREIGN PATENT DOCUMENTS

JP 1-307195 * 12/1989 ..... H05K/3/02
JP 7-263042 10/1995 ..... H01R/4/64

* cited by examiner

*Primary Examiner*—Michael Friedhofer
(74) *Attorney, Agent, or Firm*—Ostrolenk, Faber, Gerb & Soffen, LLP

(57) ABSTRACT

A switch operating unit for a camera is assembled in the switch supporting frame of the front cover thereof and provided with an inner button, an outer button, and a dial for switch operation. Under the buttons and the dial, there is provided a metal supporting plate for supporting same. Under the supporting plate, there is provided a flexible printed circuit (FPC). Since the contact of the supporting plate is in contact with the ground pattern on the FPC, even when static electricity is generated with or applied to those buttons or the dial, such static electricity is directed to the ground through the supporting plate. Thus, the electronic circuit element mounted on the FPC is protected against static electricity.

18 Claims, 3 Drawing Sheets

PRIOR ART

ELECTROSTATIC INSULATION FOR AN OPERATING UNIT FOR ELECTRONIC EQUIPMENT

BACKGROUND OF THE INVENTION

1. Field of the Invention

The present invention relates to electrostatic insulation for an operating unit for electronic equipment that perform a variety of operations.

2. Related Art Statement

Conventionally, electronic equipment, such as a camera, is provided with an operating unit having operating members for performing a variety of operations. In such apparatuses, however, static electricity generated at operating portions of the operating members must be prevented from effecting electric circuits within the equipment because such static electricity may cause the failure of an electric circuit element.

An operating unit for electronic equipment presented and disclosed in Japanese Unexamined Patent Publication No. 7-263042 comprises a switch circuit substrate 34 disposed in the casing 31 of the equipment as shown in FIG. 5. The switch circuit substrate 34 is constructed in such a manner that even when static electricity passes into the casing through the periphery of a operating button 32, it is redirected to the ground via a grounding pin 36.

The switch circuit substrate 34 is covered with an insulating sheet 35, and provided with a grounding pin 36 with one end exposed from the insulating sheet and the other end soldered to the ground pattern on the main circuit substrate 33 located within the equipment. Therefore, even when static electricity generated at or applied to the periphery of the operating button 32 enters into the electronic equipment, such static electricity will be redirected to the ground on the main circuit substrate 33 via the grounding pin 36. A switch element 37 and other components disposed on the switch circuit substrate 34 are protected against damage due to static electricity.

However, in the operating unit for electronic equipment disclosed in Japanese Unexamined Patent Publication 7-263042, as a measure against static electricity, a specific insulating sheet 35 for covering the switch circuit substrate 34 is required. Also, the grounding pin 36 attached to the insulating sheet 35 has to be connected to the main circuit substrate 33 by soldering, which could be disadvantageous in terms of space and cost.

SUMMARY OF THE INVENTION

Accordingly, it is an object of the present invention to provide an operation unit for electronic equipment which is free of the aforementioned disadvantages and is able to protect electronic parts disposed on the electric circuit against static electricity created by the operating members and the peripheries thereof, and is advantageous in terms of space and cost.

The operating unit of electronic equipment of the present invention comprises an electrically conductive supporting member for supporting the operating member, an electric circuit substrate being disposed at the inner part of the electronic equipment with respect to the supporting member and having a conductive pattern as well as an electric circuit element, and a ground connecting means for connecting the supporting member to the ground portion provided on the electric circuit substrate, wherein a part of the supporting member is in contact with the ground of the electric circuit substrate.

The operating unit for electronic equipment according to the present invention ensures protection of electronic parts on the electric circuit substrate against static electricity from the operating members or the peripheries thereof, and is advantageous in terms of space and cost.

These and other characteristics and advantages of the present invention will become more fully apparent from the following description in light of the attached drawings.

BRIEF DESCRIPTION OF THE DRAWINGS

The invention is described in detail below with reference to the following figures, throughout which similar reference characters denote corresponding features consistently, wherein.

DETAILED DESCRIPTION OF THE PREFERRED EMBODIMENT

Figure 1:
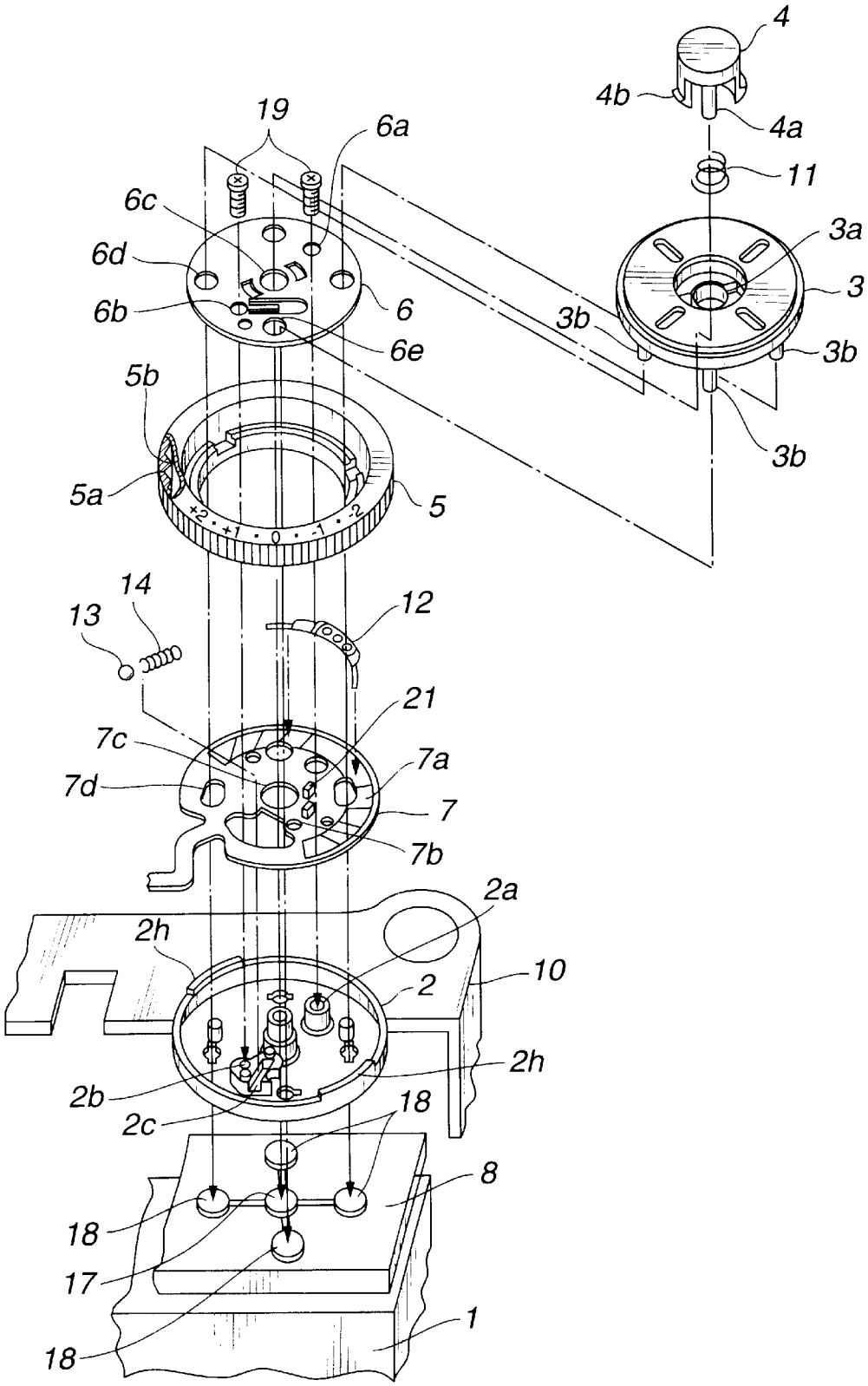
FIG. 1 is an exploded perspective view of a switch operating unit for electronic equipment in accordance with one embodiment of the present invention.

Referring now to the drawings, an embodiment of the present invention will be described.

Figure 2:
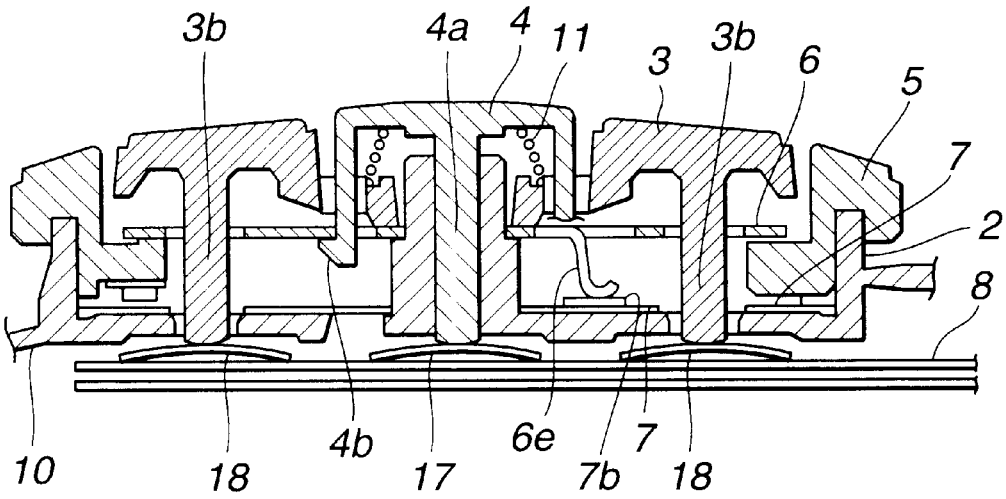
FIG. 2 is a cross-sectional detail view of the switch-operating unit in accordance with the embodiment shown in FIG. 1.
Figure 3:
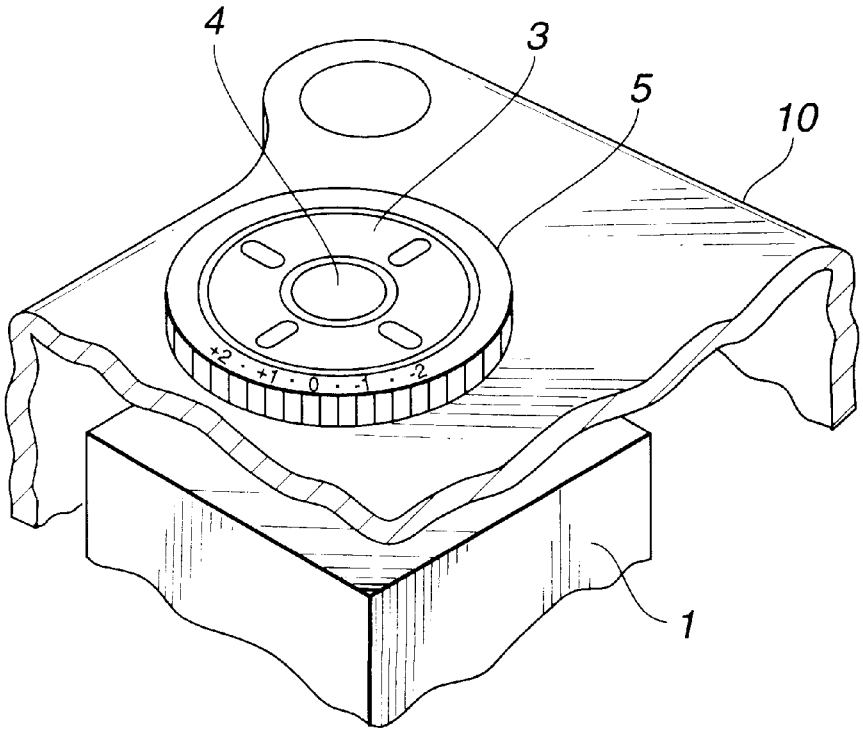
FIG. 3 is a perspective view of the switch-operating unit in accordance with the embodiment shown in FIG. 1, disposed on a camera.
Figure 4:
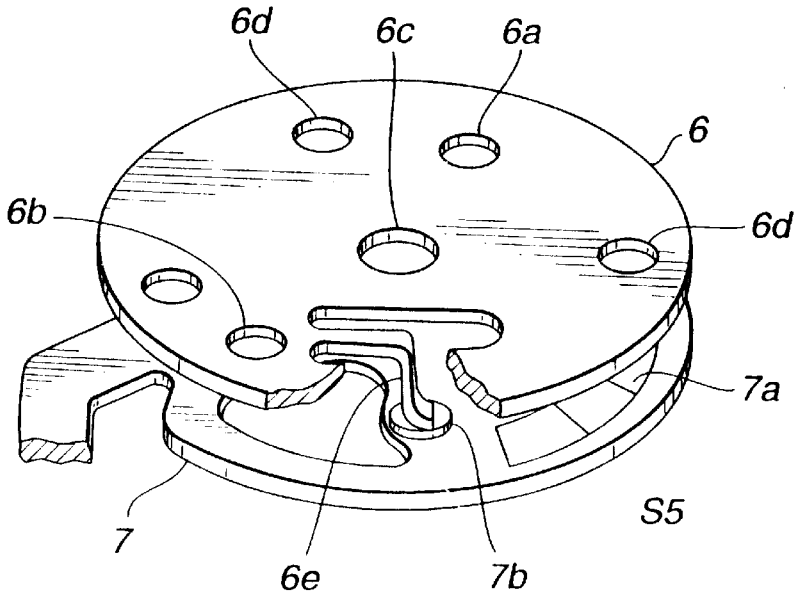
FIG. 4 is a perspective view of a supporting plate and a flexible printed circuit in the switch-operating unit in accordance with the embodiment shown in FIG. 1, as assembled.
Figure 5:
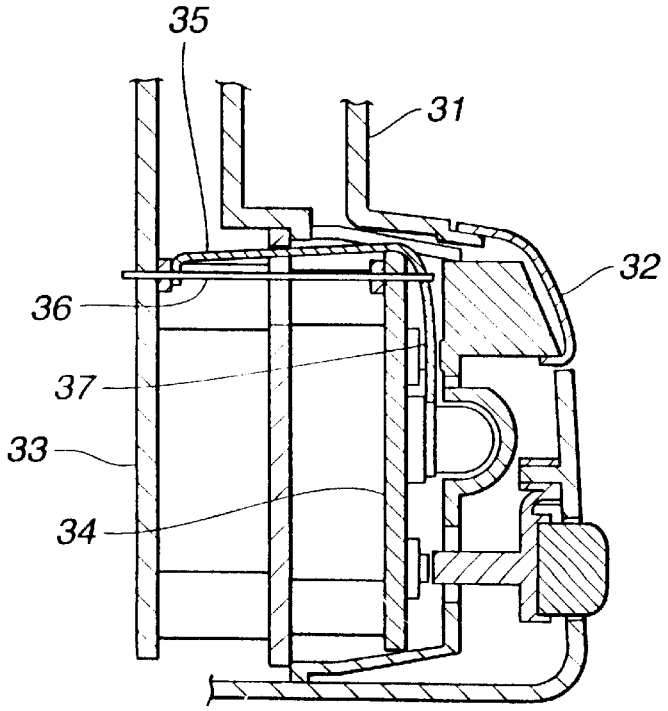
FIG. 5 is a vertical cross-sectional detail view of an operating unit for conventional electronic equipment.

FIG. 1 is an exploded perspective view of the switch operating unit for electronic equipment in accordance with one embodiment of the present invention; FIG. 2 is a vertical cross-sectional detail view of the switch-operating unit shown in FIG. 1; FIG. 3 is a perspective view of the switch-operating unit shown in FIG. 1, disposed on a camera; and FIG. 4 is a perspective view of a supporting plate for supporting a switch button and a flexible printed circuit in the switch-operating unit of FIG. 1, as assembled.

The switch-operating unit of this embodiment is a switch for setting a variety of shooting conditions of a camera. The camera includes a camera body 1 as a body of electronic equipment. A switch supporting frame 2 is formed as a part of a front cover 10 which is a camera casing. A supporting plate 6 supports the operating member and is formed of electrically conductive material, such as metal plate. A dial 5, an inner button 4, and an outer button 3 are switch-operating members. A conical spring 11 is disposed between the outer button 3 and the inner button. An electric circuit substrate provides a flexible printed circuit (hereinafter FPC) having an electrically conductive resistance pattern 7*a*. A switch substrate 8 has a slide contact segment 12 slidable on the conductive pattern 7*a* on the FPC 7 and a plurality of metal switch armatures 17 and 18 disposed under the switch supporting frame.

On the switch supporting frame 2, there a ratcheting ball retaining portion 2*c*, having an opening thereon, receives a ratcheting ball 13 for the dial 5 and a compressed spring 14 for urging the ball 13 toward the opening.

The supporting plate 6 pressably supports the outer button 3 and the inner button 4 and rotatably supports the inner periphery of the dial 5. The supporting plate 6 is positioned at a specified distance above the switch supporting frame 2 in such a manner that it covers the FPC 7. The supporting plate 6 is fixed with screws 19 passing through tapped holes 2*a* and 2*b* of the supporting frame 2. The supporting plate 6 is provided with screw inserting holes 6*a* and 6*b,* through holes 6*c* and 6*d* for receiving projecting legs 3*b* and 4*a* of the outer and inner buttons, described below, and a contact for ground connection 6*e* formed by bending a part thereof downwardly as a ground connecting means.

The dial 5 is supported by the supporting plate 6 in such a manner that the axial position of the dial 5 is limited by the supporting plate 6. The dial 5 can be rotated by holding and turning the outer peripheral portion above the switch supporting frame 2. On the inner periphery thereof, there are provided depressions 5*a* and projections 5*b* alternately at specified pitches. When the dial 5 is rotated, the depressions 5*a* and projections 5*b* effect engagement with and disengagement from the ratcheting ball 13 to allow ratcheting rotation thereof. The extent of rotation of the dial 5 is limited to the specified angle by stoppers 2*h* provided on the switch supporting frame 2.

The outer button 3 is received in the inner periphery of the dial 5 and is biased by the conical spring 11 downwardly or toward the switch supporting plate. The outer button 3 is supported so as to be tiltable in four directions on the supporting plate 6. On the outer button 3, there are provided projecting legs 3*b* which are to be passed through the supporting plate 6.

The inner button 4 has a projecting leg 4*a* which is slidably inserted into a guide hole 3*a* formed on the outer button 3 and then passed through the supporting plate 6. The inner button 4 is biased upwardly by the conical spring 11 and locked to the supporting plate 6 by means of claws. The claws inhibit the upward movement of the inner button 4, but allow a specified extent of downward movement by pressing action.

The FPC 7 is disposed on the upper surface of the switch supporting frame 2 below the supporting plate 6 and the dial 5. The FPC 7 is provided with a ground pattern 7*b* to be connected to the ground line of the electric circuit portion on the side of the body 1. The ground pattern 7*b* also connects with the above described conductive resistance pattern 7*a,* and is equipped with an electric circuit element 7*c*. Holes 7*d* and 7*c* receive projecting legs 3*b* and 4*a* of the outer and inner buttons.

The slide contact segment 12 is supported on the inner side of the dial 5 and rotated integrally therewith. By rotating the dial 5, the slide contact segment 12 slides on the conductive resistance pattern 7*a* formed of FPC 7 and outputs signals corresponding to the angular position of the dial 5 via FPC 7.

The switch substrate 8 is disposed between the lower surface of the switch supporting frame 2 and the camera body 1. A plurality of switch armatures 18 located on the upper surface of the switch substrate 8 may be selectively pressed by a plurality of projecting legs 3*b* of the outer button 3. A switch armature 17 located in the center thereof may be pressed by the projecting leg 4*a* of the inner button 4. Accordingly, the switch patterns of the switch substrate 8 positioned respectively under switch armatures 17 and 18 are turned on and off to output operation signals.

With this switch unit assembled, the supporting plate 6 and FPC 7 are supported at a specified distance as shown in FIGS. 2 and 4. The supporting plate 6 and FPC 7 are kept in contact with each other by the tip of the contact 6*e* of the supporting plate 6 being in contact with the ground pattern on FPC 7. In other words, the supporting plate 6 is electrically connected to the ground line of the electric circuit portion on the side of the body 1 via the ground pattern 7*b*.

With this switch-operating unit constructed as described, by pressing the inner button 4, the switch armature 17 is pressed, and by pressing the outer button 3 by tilting same, any one of switch armatures 18 is pressed, which initiate associated switch-on signals output from the switch substrate 8. By rotating dial 5, output signals corresponding to the angular positions thereof are issued from FPC 7. Based on each output signal, as described above, the shooting conditions are set up by the electric circuit portion on the side of the body 1 of the equipment.

If static electricity is generated or even applied to each operating member, such as the inner button 4, the outer button 3, and the dial 5, or vicinity thereof and reaches the FPC 7, such static electricity may be redirected toward the ground line of the electric circuit portion on the side of the body 1 of the equipment through the supporting plate 6 disposed inside those operating members and the ground pattern 7*b* of FPC 7. Thus, the electronic circuit element and the like equipped on FPC 7 are protected against damage due to static electricity.

In the switch-operating unit of this embodiment, if static electricity is introduced by operating members, such as the outer button 3, the inner button 4, the dial 5 and so on into the inner electric circuit substrate, the electronic components mounted on the electric circuit may be protected against static electricity. In addition, since specific constructing members for redirecting static electricity are not required, the invention may be advantageous in terms of space and cost.

According to the present invention, as described, although static electricity may easily reach the inner electric circuit portion from the operating members, the electronic components mounted on the electric circuit substrate may be protected against static electricity because such static electricity may be redirected through the supporting member for supporting the operating members. In addition, since special constructing members for redirecting static electricity are not required, the invention may be advantageous in terms of space and cost.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Electrostatic insulation for an operating unit for electronic equipment comprising:

an operating member performing a specified function when being displaced by operation thereof;

a supporting member comprising an electrically conductive material for displaceably supporting said operating member;

an electric circuit substrate being disposed further inwardly in said electronic equipment than said supporting member, having a conductive pattern and a ground portion, and being equipped with an electric circuit element; and a ground connection means for connecting said supporting member to said ground portion formed on said electric circuit substrate.

2. The electrostatic insulation for an operating unit for electronic equipment as in claim 1, wherein said supporting member is disposed between an exposed surface of said operating member and said electric circuit substrate.

3. The electrostatic insulation for an operating unit for electronic equipment as in claim 2, wherein said supporting member is disposed generally in parallel with a prescribed area on said electric circuit substrate which is aligned with said operating member in such manner that said supporting member covers said prescribed area on said electric circuit substrate.

4. The electrostatic insulation for an operating unit for electronic equipment as in claim 2, further comprising:

a projecting leg portion provided on said operating member;

a through hole provided on said supporting member and said electric circuit substrate for receiving said leg portion therethrough.

5. The electrostatic insulation for an operating unit for electronic equipment as in claim 4, further comprising:

a switch substrate having a switch member which functions by operating said operating member;

said switch substrate being disposed at a longer distance than said electric circuit substrate with respect to said exposed surface of said operating member.

6. Electrostatic insulation for an operating unit for electronic equipment comprising:

an operating member for generating prescribed signals when being displaced by operation of an exposed portion thereof;

an electric circuit substrate disposed within a body of said electronic equipment, having a ground pattern to be connected to an electrically conductive pattern and to a ground line on an electric circuit portion of the body of said electronic equipment, and being equipped with an electric circuit element;

a supporting member comprising an electrically conductive material disposed between said electric circuit substrate and said exposed surface of said operating member; and said supporting member displaceably supporting said operating member and including a contact portion for ground connection which is kept in contact with said ground pattern on said electric circuit substrate.

7. The electrostatic insulation for an operating unit for electronic equipment as in claim 6, further comprising a supporting frame wherein said electric circuit substrate and said supporting member are fixedly disposed therein.

8. The electrostatic insulation for an operating unit for electronic equipment as in claim 6, wherein said supporting member is disposed generally in parallel with a prescribed area on said electric circuit substrate in such a manner that said supporting member covers said prescribed area on said electric circuit substrate.

9. The electrostatic insulation for an operating unit for electronic equipment as in claim 6, wherein said supporting member is formed of a plate member made of electrically conductive material, and wherein said contact portion for ground connection is formed integrally by bending a part of said plate member.

10. Electrostatic insulation for an operating unit for electronic equipment comprising:

a press operation member for generating a first switching signal by press operation thereof;

a rotating operating member rotatably disposed around said press operation member for generating a second switching signal by rotating operation thereof;

an electric circuit substrate disposed within a body of said electronic equipment, having a ground portion to be connected to an electrically conductive pattern and to a ground line on an electric circuit portion of the body of said electronic equipment, and being equipped with an electric circuit element;

a supporting member having electrical conductivity disposed at a prescribed distance from said electric circuit substrate on one side of said press operating member and said rotating operating member;

said supporting member displaceably supporting said press operation member and said rotating operation member and including a contact portion for ground connection which is kept in contact with a ground portion on said electric circuit substrate.

11. The electrostatic insulation for an operating unit for electronic equipment as in claim 10, wherein said rotating operating member is provided with a slide contact segment, wherein said electric circuit substrate is provided with a conductive pattern for generating a second switching signal corresponding to the rotation of said rotating operation member, and wherein said supporting member is disposed generally in parallel with a prescribed area on said electric circuit substrate in such a manner that said supporting member covers said prescribed area on said electric circuit substrate.

12. The electrostatic insulation for an operating unit for electronic equipment as in claim 10, wherein said supporting member is formed of a plate member made of electrically conductive material, and wherein said contact portion for ground connection is formed integrally by bending a part of said plate member.

13. The electrostatic insulation for an operating unit for electronic equipment as in claim 11, wherein said supporting member is opposed to said prescribed area on said electric circuit substrate, and has a surface of almost the same size as the prescribed area on said electric circuit substrate and as said rotating operating member.

14. Electrostatic insulation for an operating unit for electronic equipment comprising:

an inner button operating member for pressing a first switch portion by press operation thereof in a an operation direction to move said inner button operating member;

an outer button operating member disposed around the outer periphery of said inner button operating member so as to allow rolling and tilting movement thereof for operating one of a plurality of switches of a second switch portion by selectively pressing a desired portion thereof to move said outer button operating member in a direction which is almost the same as the operating direction of said inner button operating member;

a rotating operating member having an axis of rotation and disposed rotatably around said outer button operating member for actuating a third switch portion by rotation thereof;

an electric circuit substrate disposed within a body of said electronic equipment, having a ground portion to be connected to a signal pattern and a ground line on an electric circuit portion of the body of said electronic equipment, and being equipped with an electric circuit element;

a supporting member having electrical conductivity disposed at a prescribed distance from said electric circuit substrate on a side where said inner button operating member, said outer button operating member, and said rotating operating member are located;

said supporting member displaceably supporting said inner button operating member, said outer button operating member, and said rotating operating member, and including a contact portion for ground connection which is kept in contact with a ground portion on said electric circuit substrate.

15. The electrostatic insulation for an operating unit for electronic equipment as in claim 14, further comprising a supporting frame wherein said electric circuit substrate and said supporting member are fixedly disposed therein.

16. The electrostatic insulation for an operating unit for electronic equipment as in claim 15, further comprising:

a switch substrate including said first and second switch portion disposed under said supporting frame, wherein said third switch portion includes said conductive pattern formed on said electric circuit substrate and said slide contact segment provided on said rotating operating member.

17. The electrostatic insulation for an operating unit for electronic equipment as in claim 16, further comprising:

a first projecting leg portion provided on said inner button operating member for pressing said first switch portion;

a second projecting leg portion provided on said outer button operating member for pressing said second switch portion; and through holes provided on said supporting member and said electric circuit substrate respectively opposed to said first and second leg portions so that said first and second leg portions may pass through to reach said first and second switch portions.

18. The electrostatic insulation for an operating unit for electronic equipment as in claim 14, wherein said supporting member limits the pressing movements of said inner operating member and said outer operating member in the respective operation directions, and the axial position of said rotating operating member.

* * * * *